United States Patent [19]

Kessler

[11] 4,057,143

[45] Nov. 8, 1977

[54] SHIPPING CARTON FOR PLUSH REELS

[75] Inventor: Theodore P. Kessler, Rancocas, N.J.

[73] Assignee: Timron, Inc., Moorestown, N.J.

[21] Appl. No.: 605,442

[22] Filed: Aug. 18, 1975

[51] Int. Cl.[2] ..... B65D 85/66

[52] U.S. Cl. ..... 206/400; 229/40

[58] Field of Search ..... 206/400, 408; 229/DIG. 14

[56] References Cited

U.S. PATENT DOCUMENTS

| | | | |
|---|---|---|---|
| 1,584,972 | 5/1926 | Bliss | 229/23 R |
| 1,882,565 | 10/1932 | Boeye | 229/37 R X |
| 2,435,878 | 2/1948 | Dunning | 229/DIG. 14 |
| 2,922,516 | 1/1960 | Kessler | 206/408 |
| 3,486,612 | 12/1969 | Kivell | 206/320 |
| 3,749,300 | 7/1973 | Jones | 229/48 R X |

*Primary Examiner*—William Price
*Assistant Examiner*—Douglas B. Farrow
*Attorney, Agent, or Firm*—Kenyon & Kenyon, Reilly, Carr & Chapin

[57] ABSTRACT

In order to form a shipping carton, the wrapper has adhesive such as a hot melt glue applied along the two side edges. Thereafter, the wrapper is circumferentially wrapped about the loaded reel to adhere the wrapper to the protruding cars on the end boards while leaving an end of the wrapper project. Next, this projecting edge of the wrapper is provided with a similar adhesive and folded against the opposite edge of the wrapper in overlapping relationship. At this time, suction is applied against the side wall of the carton to support the overlapped edge of the wrapper against the overlapping edge. The flat seam formed by the overlapped edges of the wrapper may be disposed at a corner of the carton or along a side of the carton. The end flaps of any carton may also be adhesively secured together by the described technique by holding one portion under suction while the other portion is pressed against the held portion.

4 Claims, 11 Drawing Figures

13
18
16
27
29
23
14
10
11
34
17
15
28
20
21
40
44
42
41
43
30
31
32
24

Fig. 4.
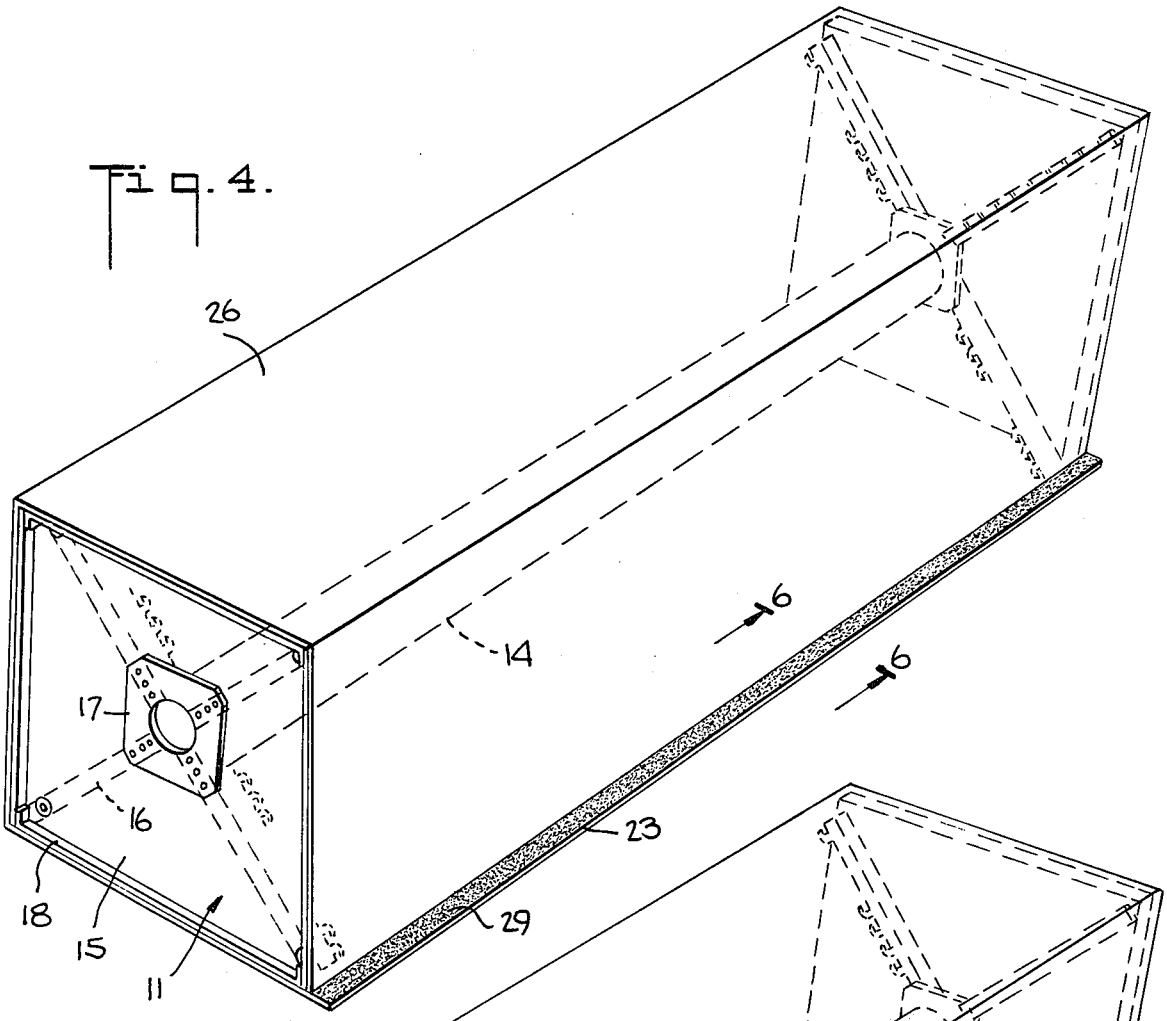
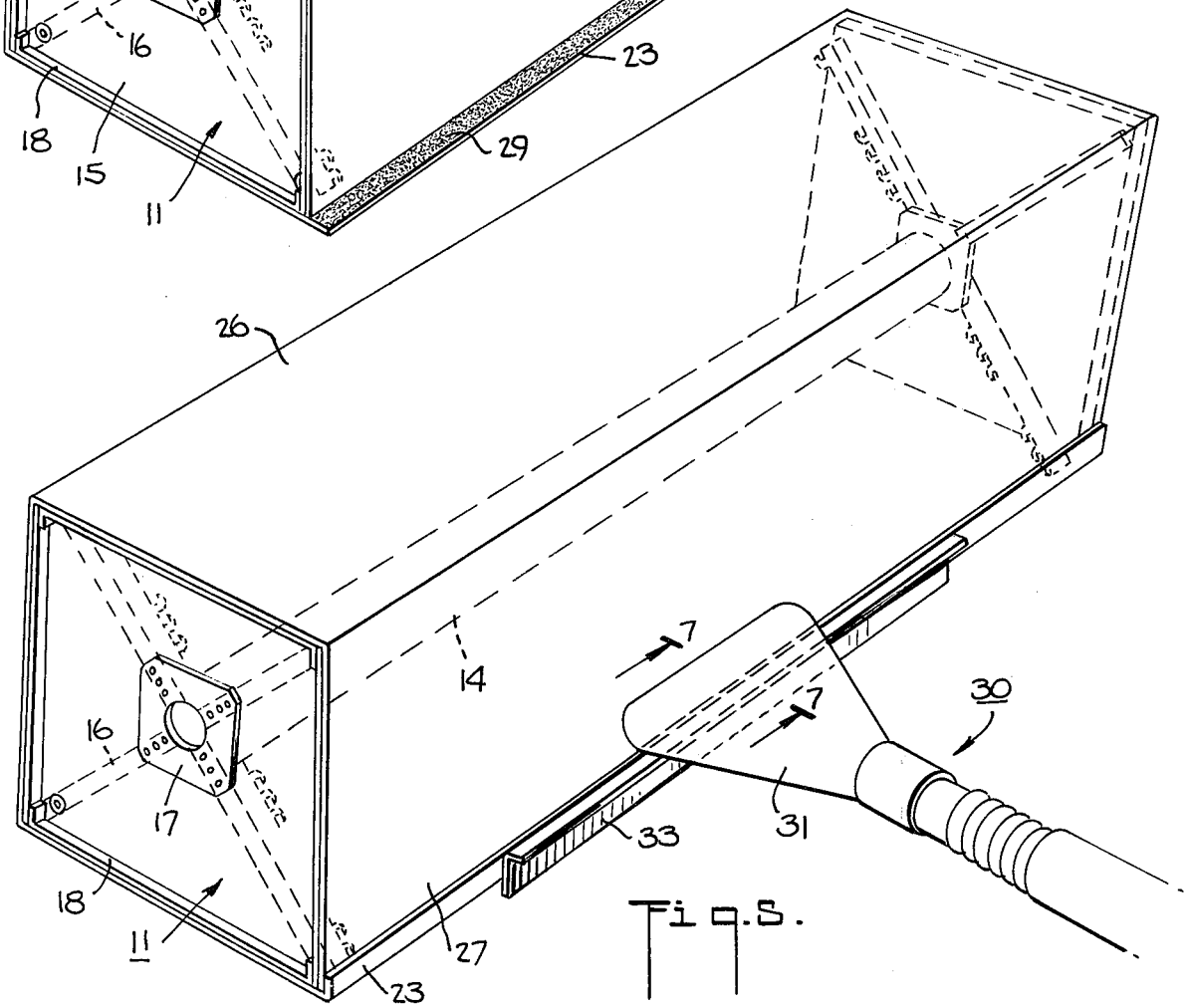
Fig. 5.

SHIPPING CARTON FOR PLUSH REELS

This invention relates to a shipping carton and a method of forming shipping cartons. More particularly, this invention relates to a shipping carton for pile fabrics and to a method of forming a shipping carton for pile fabrics.

Heretofore, various types of shipping cartons have been known for pile fabric. In some cases, the shipping cartons have been made separate from a reel. In this case, after the pile fabric has been wound up on the reel frame, the loaded frame has been placed into a preformed shipping carton and the carton sealed for shipping purposes. In other cases, the shipping cartons use the reels as an integrated part. In such cases, the reel has usually been made with end frames which include a cardboard plate having projecting ears along the edges for receiving an encircling sheet of cardboard which acts as a wrapper. An example of such an integrated carton is described in U.S. Pat. No. 2,922,516. In use, once the reel has been loaded with pile fabric, the wrapper is circumferentially enveloped about the reel and the side edges of the wrapper are stapled to the projecting ears of the respective end boards. At the same time, the two terminal edges of the wrapper, that is, the starting edge and trailing edge, are abutted together in sandwich fashion and stapled together. However, these abutting edges have projected outwardly from the carton in a dog-eared fashion. As a result, when a multitude of cartons are being shipped, these projecting dog-eared portions act as spacers between adjacent cartons such that the shipping space is not optimized. In addition, because these dogged-eared portions project from the cartons, there is a danger that these portions will become damaged during shipping to such an extent that the pile fabric becomes exposed. This may lead to damage of the pile fabric.

Accordingly, it is an object of this invention to provided a shipping carton which occupies a minimum of space during shipping.

It is another object of the invention to provide a simple method of forming a shipping carton of limited contour.

It is another object of the invention to form a shipping carton for pile fabric which has no projecting edges on the sidewalls.

It is another object of the invention to provide a shipping carton with a substantially smooth continuous sidewall construction.

It is andother object of the invention to provide a method of forming a shipping carton which requires relatively simple tools.

It is another object of the invention to provide a continuous seal between the overlapping edges of the wrapper of a shipping carton.

Briefly, the invention provides a shipping carton of substantially smooth continuous contour and a method of forming the shipping carton.

The shipping carton is of an integrated type which comprises a reel for pile fabrics including a pair of end frames each of which has an end board of polygonal shape with a peripheral ear projecting in perpendicular relation to the remainder of the board, a wrapper circumferentially disposed about the reel, and an adhesive securing the ears of the end frames to the side edges of the wrapper and the terminal edges of the wrapper to each other in overlapping relation longitudinally of the reel.

The adhesive which is applied to the wrapper may be of a pressure sensitive type or may be a hot melt glue. The adhesive extends continuously along each side edge of the wrapper and along a surface of at least one of the terminal edges of the wrapper.

The carton may be constructed so that the seam formed by the overlapping terminal edges of the wrapper are located along a longitudinal corner of the carton. Alternatively, the seam may be located between two corners of the carton, that is, intermediately of a carton sidewall.

The outer peripheral contour of the cartonis substantially smooth since the terminal edges of the wrapper are disposed in overlapping relationship. In this way, there are no projections of the terminal edges from the carton except for the thickness of the carton at the seam formed by the overlapping terminal edges. In this respect, the thickness of the cardboard used may vary from $\frac{1}{8}$ inches to $\frac{1}{2}$ inches.

The method of the invention includes the steps of adhesively securing a wrapper circumferentially about and to a reel, and of adhesively securing the terminal edges of the wrapper to each other in overlapping relation while holding the wrapper adjacent the overlapped edge under an externally applied suction force in order to support the overlapped edge against the overlapping edge.

Where the reel includes a pair of end frames, each of which has an end board of polygonal shape including a peripheral ear projecting in perpendicular relation, the wrapper may be formed of a sheet of cardboard which is provided with a strip of adhesive along a pair of side edges. In accordance with the method, the sheet of cardboard is wrapped about the reel with the side edges disposed over the ears of the end boards so as to adhesively secure the wrapper to the end boards. In order to seal the terminal edges of the wrapper together, adhesive is applied to at least one of the terminal edges and the edges are then placed in overlapping relation. Pressure is then applied to the overlapped edges while the wrapper adjacent the overlapped terminal edge is held under an externally applied suction force which supports the overlapped edge against the overlapping edge. After a seam is formed, the suction force and pressure are removed.

The method may also be used to close any two portions of a shipping carton together. In this case, adhesive is provided along at least one of the carton portions and the two portions are then disposed in overlapping relation. Pressure can then be applied against the overlapping portion while the overlapped portion is held under an externally applied suction force in order to support the overlapped portion against the overlapping portion.

These and other objects and advantages of the invention will become more apparent from the following detailed description and appended claims taken in conjunction with the accompanying drawings in which:

FIG. 4 illustrates the position of the wrapper immediately prior to folding against the initial terminal end of the wrapper;

FIG. 5 illustrates the shipping carton in relation to a vacuum means for holding the side wall of the shipping carton against the folded over terminal edge;

Figure 1:
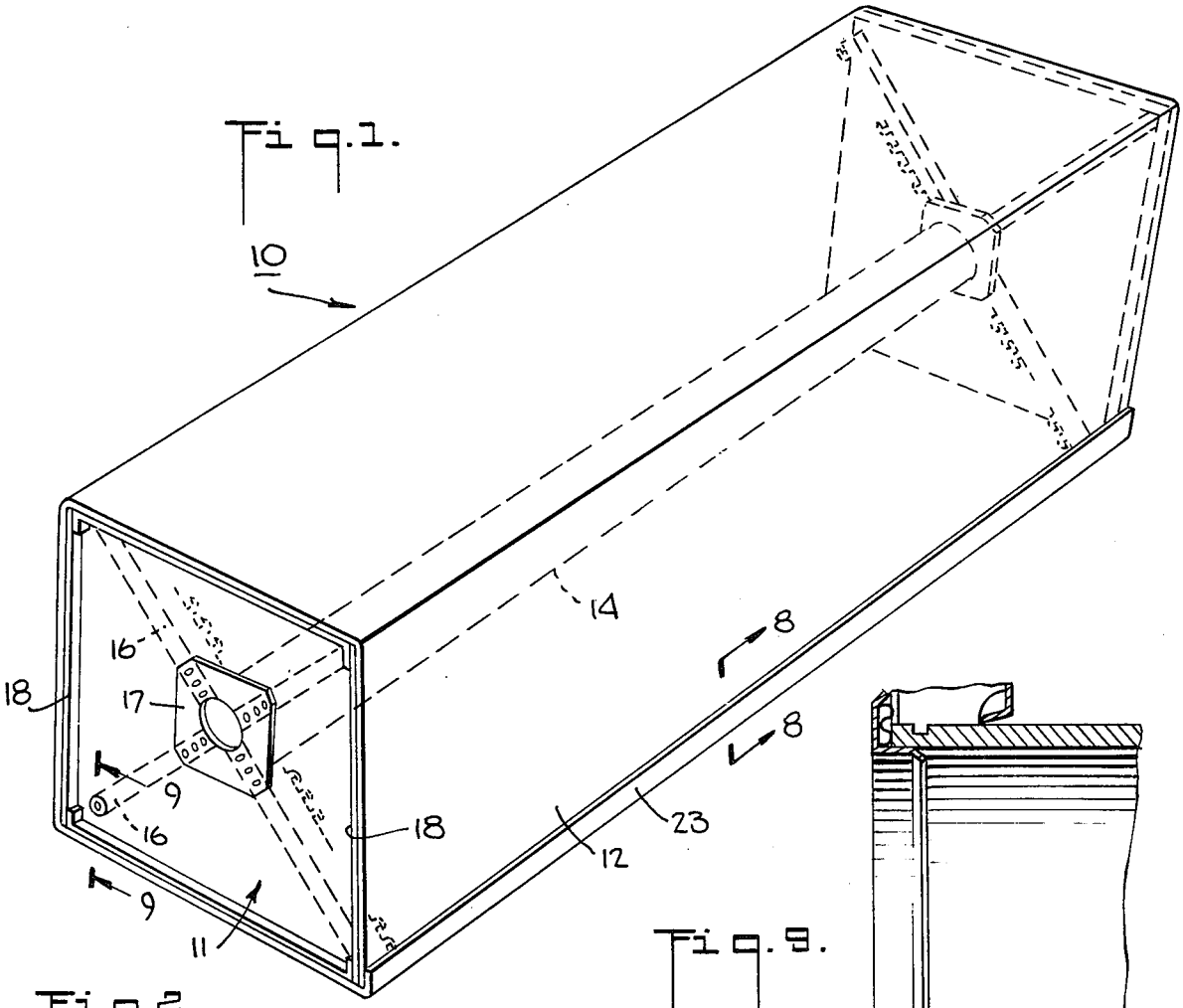
FIG. 1 illustrates a perspective view of a shipping carton in accordance with the invention.

Referring to FIG. 1, the shipping carton 10 is constructed of a reel 11 and a wrapper 12 which circumferentially envelopes the reel 11.

Figure 3:
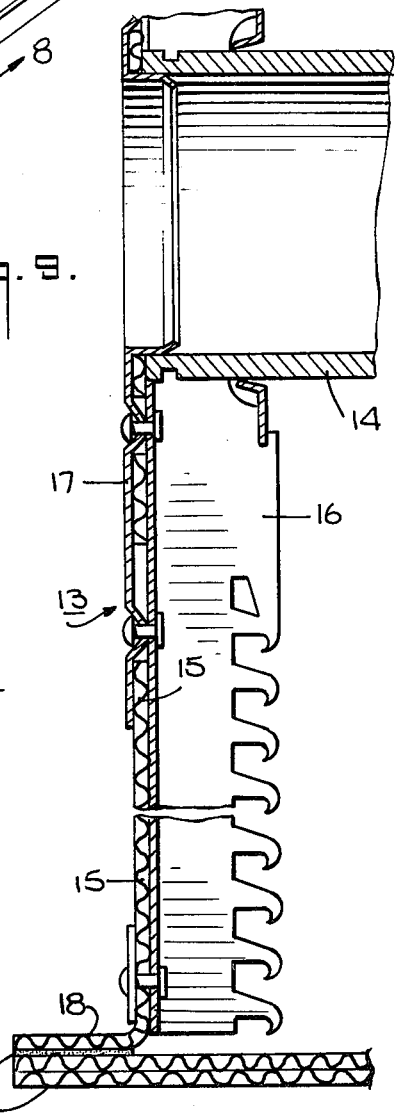
FIG. 3 illustrates an exploded view of a reel and the wrapper of FIG. 2 prior to assembly.

Referring to FIG. 3, the reel 11 is constructed, for example as described in my U.S. Pat. No. 3,944,157, of a pair of end frames 13 and a spacer bar 14 which is mounted in the end frames 13 to space the end frames 13 apart. Each end frame 13 includes a cardboard end board 15 of rectangular shape, a plurality of hook strips 16 and an end plate 17 secured to the hook strips 16 from outside the end board 15. Each of the end boards 15 has a peripheral ear 18 which projects in a perpendicular relation to the remainder of the end board 15. Each ear 18 is formed by forming sutiable slits in the end board 15 and folding over the four edges of the end board 15.

Figure 2:
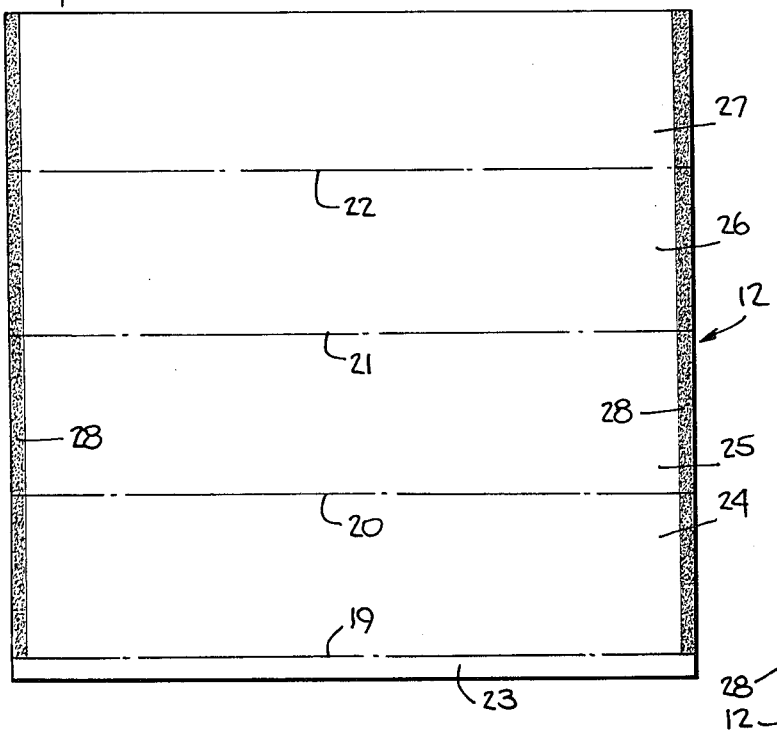
FIG. 2 illustrates a pre-creased cardboard sheet having adhesive along two edges for use as a wrapper in making the carton of FIG. 1.

The wrapper 12, as shown in FIG. 2, consists of a rectangular cardboard sheet which is pre-creased along four lines 19–22 to form five panels 23–27 and provided with an adhesive 28 such as a hot melt glue along the two side edges. The wrapper 12, as shown in FIG. 1, forms four sidewalls of the carton 10 as well as longitudinal seam along one corner of the carton 10. The cardboard wrapper 11 may be of a single or double walled construction; a double walled construction being illustrated in the various drawings.

In order to form the carton, the reel 11 is first loaded with a pile fabric in any known fashion. Thereafter, the wrapper 12 is then wrapped circumferentially about the reel (see FIG. 3). In this case, the initial panel 23 of the wrapper 12 is allowed to project from the reel profile so that the succeeding panels 24–27 envelope the reel 11 to form four sidewalls. The trailing terminal edge of the wrapper 7 is thus positioned within the plane of the sidewall of the carton formed by the trailing panel 27 in perpendicular relation to the initial panel 23. This is more particularly shown in FIG. 4.

Figures 6, 7, 8, 9, 10, 11:
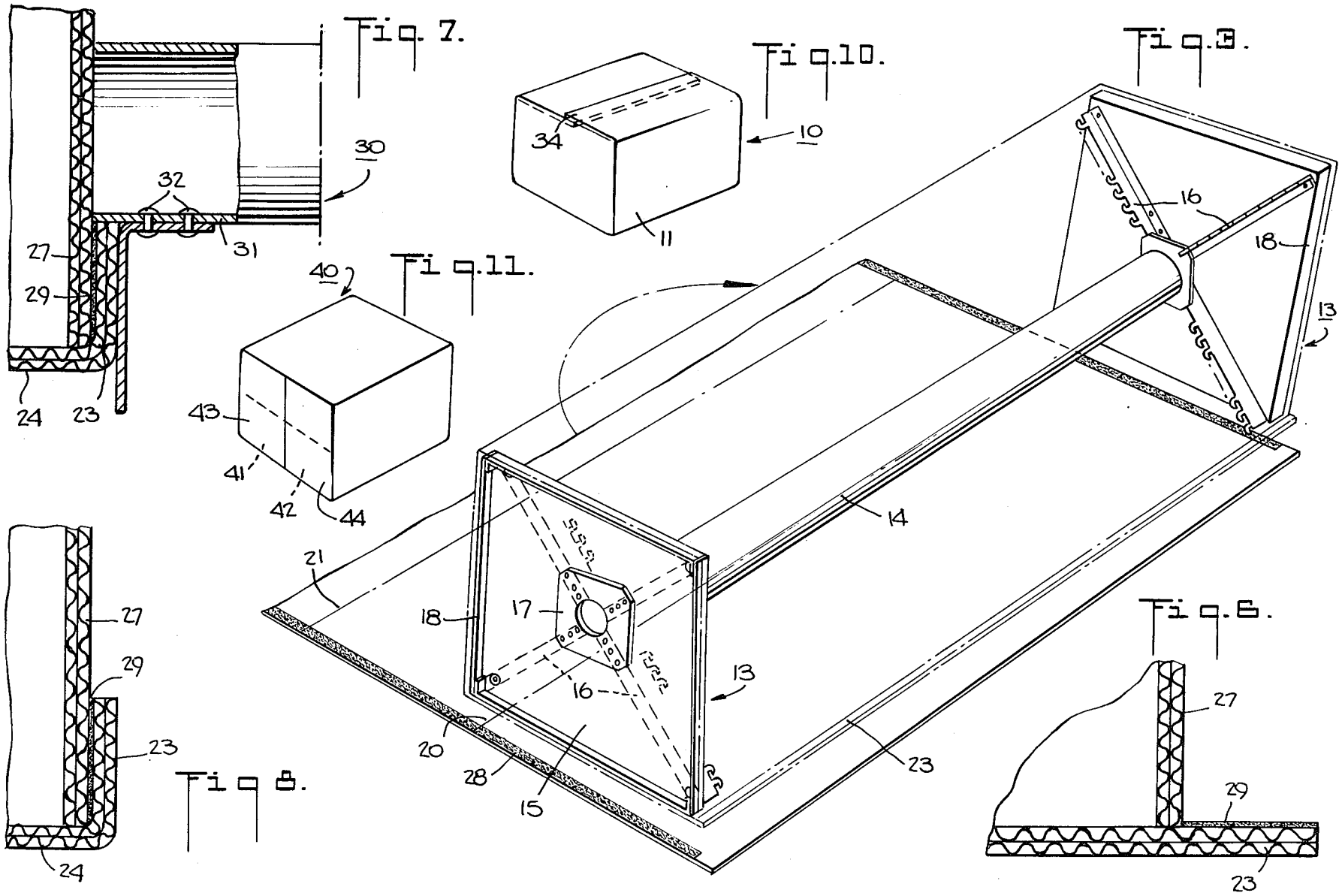
FIG. 6 illustrates a view taken on line 6—6 of FIG. 4.
FIG. 7 illustrates a view taken on line 7—7 of FIG. 5.
FIG. 8 illustrates a view taken on line 8—8 of FIG. 1.
FIG. 9 illustrates a view taken on line 9—9 of FIG. 1.
FIG. 10 illustrates a fragmentary view of a side of a shipping carton having a seam formed intermediately of a side wall in accordance with the invention.
FIG. 11 illustrates a carton formed in accordance with the invention.

Thereafter, an adhesive 29 (FIG. 6) such as a hot melt glue, a cold setting glue, or a pressure sensitive adhesive of suitable type is applied along the inside surface of the terminal edge (panel 23), for example in line form, and this edge folded about the crease 19 against the sidwall (panel 29) of the carton 10. At the same time, as shown in FIGS. 5 and 7, a suction force is applied by a vacuum means 30 against the portion of the carton sidewall (panel 27) adjacent to the overlapped terminal edge against the pressure applied by the adhesively coated overlapping terminal edge (panel 23). In this way, the overlapped edge is supported against the overlapping edge so that a smooth continuous seam (FIG. 8) is formed along the corner of the carton. The suction force applied through the tube 31 on the carton side wall (panel 27) should be sufficient to hold the side wall in place. If not, the carton may be moved across the suction tube 31, or vice versa, during the seaming operation to insure a smooth continuous seam. For example, the suction force may be about 0.5 psi. Alternatively, an oversized suction tube or a plurality of stationary suction tubes may be used depending on the carton.

As shown in FIG. 7, the suction means 30 may be any industrial or commercial vacuum typed cleaner. In addition, the suction means 30 has a tube 31 fixedly mounted as by rivets 32, on a spacer 33 mounted on a work table (not shown). This allows positioning and passage of the overlapping edge 23 under the suction tube 31. In order to further guide the suction tube 31, one or more rollers or the like can be mounted along the opposite ends of the tube mouth. Such rollers would not only permit smooth rolling of the tube 31 along the carton but also would space the tube 31 slightly from the surfaces of the carton.

Referring to FIGS. 1 and 9, the peripheral ear 18 of each end board 15 is secured by the adhesive 23 to a side edge of the wrapper 12. In the case where the adhesive is a pressure sensitive type, the ears 18 of the end boards 15 and the side edges of the wrapper 12 can be pressed together by any suitable means to enhance the adhesive securement.

It is to be noted that in the absence of the suction force on the sidewall of the carton, the overlapped edge of the wrapper 11 would have a tendency to push away when pressure is applied against the folded over edge (panel 23) of the wrapper since the folded over edge would then be unsupported.. This, in turn, would preclude the formation of a smooth continuous seam between the overlapped edges.

As shown, the terminal edges of the wrapper 11 are imperforate and are unsupported from within the carton during the seaming operation. Further, the adhesive secures the terminal edges of the wrapper 11 to each other without buckling of the wrapper. As such, the adhesive is applied under a pressure which is sufficient to form the seam but which is not sufficient to cause a bowing or buckling of the wrapper.

Referring to FIG. 10, the seam 34 formed by the overlapped edges of the wrapper 11 may alternatively be formed between two corners of the carton 10 so that the seam runs longitudinally along a midpoint of one of the sidewalls.

Referring to FIG. 11, the technique of adhesively securing two portions of a carton may also be applied to the end flaps of a shipping carton 40 of any suitable type. In this case, with two inner flaps 41, 42 folded over, one end flap 43 is provided with adhesive on the inside and pressed against the two inner flaps 41, 42 while the inner flaps 41, 42 are held under an externally applied suction force, as by a vacuum means described above. Thereafter, the second end flap 44 is provided with adhesive and pressed against the inner flaps 41, 42 while the suction force is applied to the end flap 43 secured to the inner flaps 41, 42.

The invention thus provides a shipping carton for pile fabric frames which is of smooth contour without projections of the side walls. For example, as described above, the shipping carton maintains a rectangular cross-sectional shape without any projecting tabs or ears.

Further, the invention provides a method which can be simply utilized through the use of simple tools.

What is claimed is:

1. A shipping carton comprising a reel for pile fabric including a pair of end frames and a spacer bar disposed between said end frames, each end frame including an end board of polygonal shape having a peripheral ear projecting therefrom in perpendicular relation;

a cardboard sheet wrapper disposed about said reel, said wrapper having a pair of oppositely disposed side edges disposed about a said ear of a respective end board of said reel and pair of oppositely disposed terminal edges disposed in overlapping relation longitudinally of said reel, said terminal edges being unsupported from within the carton and being imperforate; and adhesive securing said ears of said end frames to said side edges to said wrapper and said terminal edges of said wrapper to each other without buckling of said wrapper said adhesive being such that the pressure required to complete the securement is capable of buckling the unsupported terminal edges.

2. A shipping carton as set forth in claim 1 wherein said adhesive is a cold setting glue.

3. A shipping carton set forth in claim 2 wherein said adhesive is a pressure sensitive adhesive.

4. A shipping carton as set forth in claim 1 wherein said adhesive is a hot melt glue.

* * * * *

UNITED STATES PATENT AND TRADEMARK OFFICE

CERTIFICATE OF CORRECTION

PATENT NO. : 4,057,143

DATED : November 8, 1977

INVENTOR(S) : Theodore P. Kessler

It is certified that error appears in the above-identified patent and that said Letters Patent are hereby corrected as shown below:

In the Abstract

Line 5, change "cars" to -- ears --

Column 1, lines 39 and 40 change "provided" to -- provide --

Column 1, line 51 change "and other" to -- another --

Column 2, line 14, change "cartonis" to -- carton is --

Column 3, line 57 change "sidwall" to --sidewall --

Column 6, line 2, change "to" to -- of --

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*